US007448842B2

(12) United States Patent
Schonauer

(10) Patent No.: US 7,448,842 B2
(45) Date of Patent: Nov. 11, 2008

(54) INDUSTRIAL TRUCK HAVING A PALLET GRIPPER

(75) Inventor: Michael Schonauer, Moosburg (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 184 days.

(21) Appl. No.: 11/190,566

(22) Filed: Jul. 27, 2005

(65) Prior Publication Data

US 2006/0175134 A1 Aug. 10, 2006

(30) Foreign Application Priority Data

Aug. 18, 2004 (DE) ..... 10 2004 040 065

(51) Int. Cl.
*B61D 45/00* (2006.01)

(52) U.S. Cl. ..... 414/785; 414/621; 410/80

(58) Field of Classification Search ..... 410/77, 410/80; 414/619, 621, 607–608, 622, 785; 187/237

See application file for complete search history.

(56) References Cited

U.S. PATENT DOCUMENTS

| | | | | |
|---|---|---|---|---|
| 3,493,137 | A | 2/1970 | Nilsen et al. | |
| 3,593,672 | A * | 7/1971 | Breen et al. | 410/129 |
| 4,948,326 | A * | 8/1990 | Bedard | 414/541 |

FOREIGN PATENT DOCUMENTS

| | | | |
|---|---|---|---|
| DE | 1431747 | | 11/1968 |
| DE | G 80 28 327.8 | | 3/1981 |
| DE | 102 59 704 | A1 | 8/2003 |
| GB | 2 137 161 | A | 10/1984 |
| GB | 2 385 312 | A | 8/2003 |
| GB | 2385312 | | 8/2003 |
| JP | 2001316095 | A | 11/2001 |
| JP | 2002012397 | A | 1/2002 |

OTHER PUBLICATIONS

German Search Report dated May 9, 2005.
Crown Catalog Product Literature, Crown 1994 PF 10187-3.

* cited by examiner

*Primary Examiner*—Stephen Gordon
(74) *Attorney, Agent, or Firm*—Scott D. Wofsy; Edwards Angell Palmer & Dodge LLP

(57) ABSTRACT

The present invention relates to an industrial truck (10) having a load-receiving device (14) for the purpose of receiving a load (34), said load-receiving device (14) having a clamping device (23) in order to hold a clamping region (36) of the received load (34) in clamping engagement, the clamping device (23) having at least one clamping mechanism (24, 28) which can move between a clamping position and a release position, a drive arrangement (40), which is coupled to at least one of the clamping mechanisms (24, 28), for the purpose of moving the clamping mechanisms (24, 28) and an elastic device (42) which prestresses the clamping mechanisms (24, 28) towards one of the positions. With the industrial truck according to the invention, provision is made for the elastic device (42) to prestress the clamping mechanisms (24, 28) in the direction of the clamping position and to exert a clamping force on the clamping region (36) of the load (34) in the clamping position.

19 Claims, 2 Drawing Sheets

INDUSTRIAL TRUCK HAVING A PALLET GRIPPER

Figure 1:
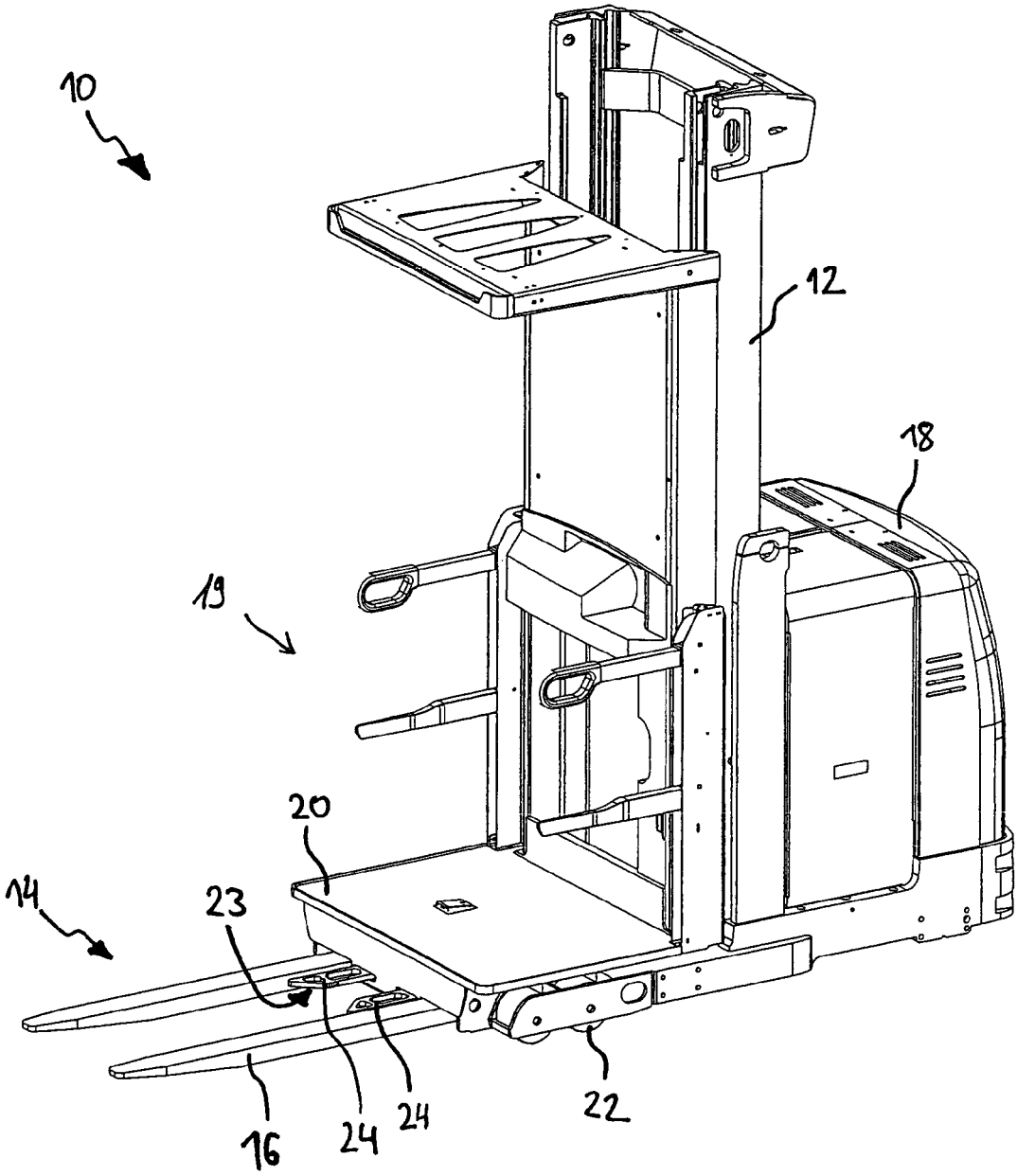

The present invention relates to an industrial truck having a load-receiving device for the purpose of receiving a load, said load-receiving device having a clamping device in order to hold a clamping region of the received load in clamping engagement, the clamping device having clamping means which can move between a clamping position and a release position, a drive arrangement, which is coupled to at least one of the clamping means, for the purpose of moving the clamping means and an elastic device which prestresses the at least one clamping means, which is coupled to the drive arrangement, towards one of the positions.

Industrial trucks of this type are known, for example, as stackers which have, as the load-receiving device, a horizontal bearing plate or bearing fork which can be moved in the vertical direction in order to lift a load and to transport it between two points, for example. The load received by the industrial truck in this case often comprises a load carrier, for example a pallet, and transported goods which are placed on the load carrier. The load-receiving device then grips the load carrier for the purpose of receiving the load.

It is furthermore known to hold a load received by the load-receiving device of the industrial truck in clamping engagement by means of a clamping device in order to prevent the load from sliding or even falling off from the load-receiving means. It is necessary for the load to be held on the load-receiving device by means of the clamping device in particular when other external static and/or dynamic forces are acting on the load, for example in the event of a movement of the entire industrial truck, in the event of an inclination of the load-receiving means or else when, for example, an operator of the industrial truck steps onto the load for loading and unloading purposes. It is therefore usual for an operator to step onto a palette which is borne by the forks of a fork-lift truck in order to load transported goods onto the pallet, to fix them there or to unload them from this pallet. The clamping device in this case ensures that the pallet is positioned securely on the fork-lift truck when different loads are placed on the pallet by the operator.

A generic industrial truck comprises a clamping device by "Crown" for the purpose of holding a pallet. This clamping device is known, inter alia, from a "Crown" catalogue from the year 1994. The known clamping device comprises two clamping levers which can pivot towards and away from one another about a common pivot. A cable pull, which is actuated by means of a foot pedal and can be locked, grips one of the two clamping levers in order to pivot them when the foot pedal is depressed such that a clamping section of one clamping lever moves towards a clamping section of the second clamping lever in order to hold a foot part of the pallet in clamping engagement between the clamping sections. The clamping lever connected to the cable pull is prestressed by two springs in the open position of the clamping device.

In order to hold the foot part of the pallet in clamping engagement between the clamping sections, a force needs to be continuously applied to at least one of the clamping levers in the closing direction of the clamping device, i.e. in the direction towards the clamping position, this force needing to overcome the prestress of the two springs acting on the clamping lever such that only some of the force can be used as clamping force. Although the known clamping device makes it possible to lock the foot pedal in the depressed position, this means that the clamping levers are held in the clamping position but, owing to the lock, often no longer press against the foot part of the pallet with a defined clamping force.

Finally, the additional provision of a lock entails additional design complexity, costs and laborious operation.

The object of the present invention is therefore to provide an industrial truck of the type mentioned initially whose clamping device securely holds the received load and at the same time is of simple design and can be operated easily.

In accordance with the present invention, this object is achieved by an industrial truck of the type mentioned initially, in the case of which the elastic device prestresses the at least one clamping means towards the clamping position for the purpose of exerting a clamping force on the clamping region of the load.

With the industrial truck according to the invention, the elastic device, which may be an elastomeric or rubber part but is preferably a gas compression spring or a Hooke's spring element, therefore acts in the direction of the clamping position such that the design complexity and the required force for holding the clamping means in the clamping position are reduced. At the same time, in the clamping position of the clamping means, the elastic device exerts a defined clamping force on the clamping region of the load via said clamping means, said clamping force securely holding the load or restricting it, at least in terms of its freedom of movement.

A particularly preferred refinement of the industrial truck according to the invention is one in which the clamping force exerted on the clamping region of the load in the clamping position of the clamping means is applied essentially exclusively by the elastic device. This makes it unnecessary for the drive arrangement in the clamping position of the clamping means to transmit a force to the said clamping means. The drive arrangement may therefore be transferred, for example, to a standby position in which it is operated in an energy-saving manner or is switched off, whereas the clamping force is applied for any desired length of time in a reliable and defined manner by the elastic device.

A clamping device for the industrial truck according to the invention may be realized in a simple manner in design terms by the clamping means being in the form of lever elements which can be pivoted about a common pivot axis. The at least two lever elements can in this case in principle be formed by only in each case one lever arm. The lever elements, however, are preferably formed with in each case at least two lever arms, in each case the elastic device acting on a first lever arm, and in each case a second lever arm being a clamping arm for the purpose of engaging with the load. The lever arms may in this case be sections of an integral or multi-part clamping means. For the purpose of an engagement between the clamping arm and the load, the clamping arms may have clamping sections which hold the load in clamping engagement essentially owing to a frictional connection and, for this purpose, have a surface or edge structure which increases the frictional force, in particular a plurality of teeth or points, or are made from a friction-enhancing material.

In one preferred development of the invention, provision is made for the clamping device to be adjustable such that it is possible to set a distance between the clamping sections of the clamping means, said clamping sections being envisaged for bearing against the clamping regions of the load, given any desired predetermined position of the drive arrangement. It is thus possible for the clamping device to be matched individually to different loads having clamping regions which are arranged differently and/or have different dimensions. The provision of an adjustable clamping device has the further advantage that, for different loads having clamping regions with different dimensions, the elastic device is operated with the same expansion path and thus can always provide a defined clamping force, preferably always essentially the same clamping force. In addition, owing to the provision of adjustable clamping means in the manner described above, the displacement path which is travelled by the drive arrangement can be kept short, and the drive arrangement can thus be designed to be simpler and more cost-effective.

A particularly simple and reliable way of designing the clamping means to be adjustable is provided in a variant of the industrial truck according to the invention, in the case of which at least one of the clamping means is of multi-part design having a clamping jaw part and a support part, and the clamping jaw part, which bears the clamping section, can be mounted on the support part of the clamping means in different mounting positions or at different mounting locations. In particular, different individual parts of the clamping device, such as the clamping jaw part and its fixing part, can be held such that they are secure against being released when the clamping means are displaced, if the clamping jaw part is attached to the support part such that it can be pivoted on the clamping section of the other clamping means towards and away from said other clamping means, it being possible for the clamping jaw part and the support part to be fixed in relation to one another by means of a locking device, in particular a locking bolt or clamping screw.

The transmission of the force from the elastic device to the clamping means for the purpose of exerting a clamping force on the clamping region of the load may be provided in a manner which is simple in design terms and at the same time is not subject to faults and using mechanical means by the coupling between the at least one clamping means and the drive arrangement comprising a slot coupling, in the case of which a pin, which is connected to the clamping means or the drive arrangement, is received in a slot in a coupling part, which is connected to the respective other assembly (drive arrangement or clamping means) such that it can be displaced in relation to said coupling part, the coupling being designed such that a force is transmitted between the pin and the coupling part essentially only by the pin bearing against a longitudinal end region of the slot (i.e. in an interlocking manner, disregarding frictional forces). The fact that a pin is received in a slot makes it possible, on the one hand, for a force to be transmitted between the pin and the coupling part having the slot when the pin bears against a longitudinal end region of the slot, and, on the other hand, to allow for a certain amount of play for a relative movement between the coupling part and the pin without any notable transmission of force between the pin and the coupling part.

With such an arrangement having a slot coupling, it is possible, in particular, for the pin, in the clamping position of the clamping device, to be located at an intermediate location between the two longitudinal end regions of the slot. There is thus a certain amount of play for a movement between the coupling part and the pin in the clamping position, with the result that there is no force reaction from the at least one clamping means, which is coupled to the drive device, to the drive device.

In one advantageous development, the clamping device also comprises a clamping position sensor which indicates that the clamping device is located in the clamping position. This has the advantage that it is possible to indicate, on a control panel or within a controller, the fact that the clamping device, which is generally not visible to the driver of the industrial truck when a load has been received, has been securely set in the clamping position, and therefore also that an indication can be made to a control/regulating device of the industrial truck or to an operator. It is therefore possible for the control signal to be used as the control signal for the drive arrangement in order to stop the movement of the drive arrangement and/or to switch the drive arrangement over to a standby state as soon as the clamping engagement is produced.

In one refinement of the clamping position sensor which is particularly simple in design terms, provision is made for the clamping position sensor to detect a location of the pin within the slot in which the clamping means are located securely in the clamping position. The detected location of the pin is preferably an intermediate location between the two longitudinal end regions of the slot since positioning of the pin at the intermediate location between the two longitudinal end regions of the slot means that the force engagement between the drive arrangement and the clamping means has been released, which is only possible under normal operating conditions when the closing force applied by the elastic device on the clamping means is absorbed by a load held in clamping engagement between the clamping means.

In order to detect the location of the pin within the slot in a simple and reliable manner, it is expedient if the clamping position sensor is connected so as to move with the coupling part.

As has been mentioned above, it is in principle sufficient for only one clamping means for the drive arrangement to be driven to move in order to move the clamping means in relation to one another from the clamping position to the release position against the force of the elastic device. For this purpose, the drive arrangement may be arranged such that it is fixed to the industrial truck frame.

An advantageous symmetrical movement of clamping means which can be pivoted in relation to one another, for example tweezer-like clamping means each having a lever arm per clamping means or tongue-like clamping means each having two lever arms per clamping means, can be obtained in accordance with one possible development of the present invention by the drive arrangement being coupled in a force-transmitting manner to each of the clamping means, which can be pivoted in relation to one another.

This may be achieved in design terms, for example, by a drive body of the drive arrangement being essentially rigidly coupled to a clamping means and a movement output part, which can move in relation to the drive body, of the drive arrangement being coupled to the other of the clamping means which are envisaged to be capable of moving in a pivoting manner in relation to one another.

However, the drive arrangement is preferably mounted securely such that it is fixed to the industrial truck frame, it in this case being possible for a movement and force-transmitting coupling to be produced between the drive arrangement and the clamping means by means of a gear mechanism, the gear mechanism also being understood to mean a rod assembly or the like.

One preferred embodiment of the invention may furthermore be designed such that the drive arrangement is connected to the clamping means for the purpose of transmitting motive force via a toggle joint arrangement, whose limbs are connected, in each case at one point, preferably at one of its longitudinal ends, to in each case one of the clamping means such that they can rotate and being connected, at another point, preferably at its other longitudinal end, to one another such that they can rotate so as to form a toggle joint, the toggle joint (of the limbs) being coupled to the drive arrangement. By using a toggle joint it is possible for a high force transmission from the drive arrangement to the clamping means to be achieved, in particular in the case of a relatively widely stretched position of the toggle. The larger displacement path, to be provided for this purpose in the return motion, of the drive arrangement or the relatively short pivoting path of the clamping means can be accepted since only a short path is required for the purpose of releasing a clamping engagement between essentially rigid clamping means and essentially fixed clamping regions of the load. It is particularly advantageously possible for clamping means also to be used in this context whose clamping sections can be adjusted in terms of their distance from one another in the manner described above for a specific position of the drive arrangement.

In one particularly preferred embodiment, the clamping device will comprise a combination of the above-described slot coupling and the toggle joint arrangement such that the driven element of the drive arrangement has the coupling part with the slot, and that a part, which is rigidly connected to the toggle joint, can be displaced along the slot.

The drive arrangement of the clamping device of the industrial truck according to the invention is preferably an electrically operable arrangement, in particular an electric motor, possibly having a transmission gearbox. In principle, a hydraulic or pneumatic piston/cylinder arrangement is also conceivable. In particular, an electrically operable drive arrangement offers the advantage that actuation of the clamping device, in particular opening of the clamping means against the force of the elastic device does not need to be carried out manually by an operator, with the result that the operational convenience of the industrial truck is increased. In addition, an electrically operable drive arrangement functions more quickly and can be driven by a databus via an electrical line. Tubes with a relatively thick cross section are not required.

Figure 2:
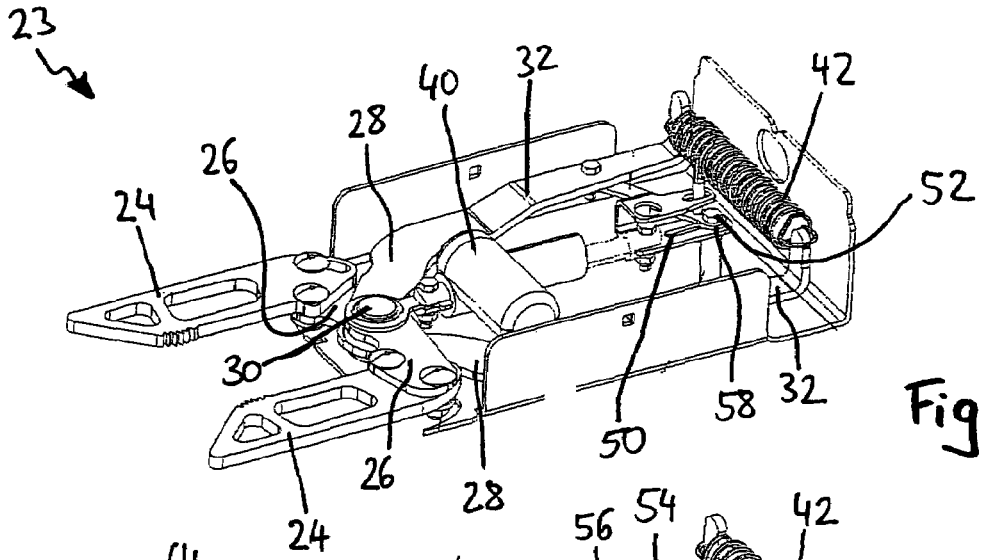
Figure 3:
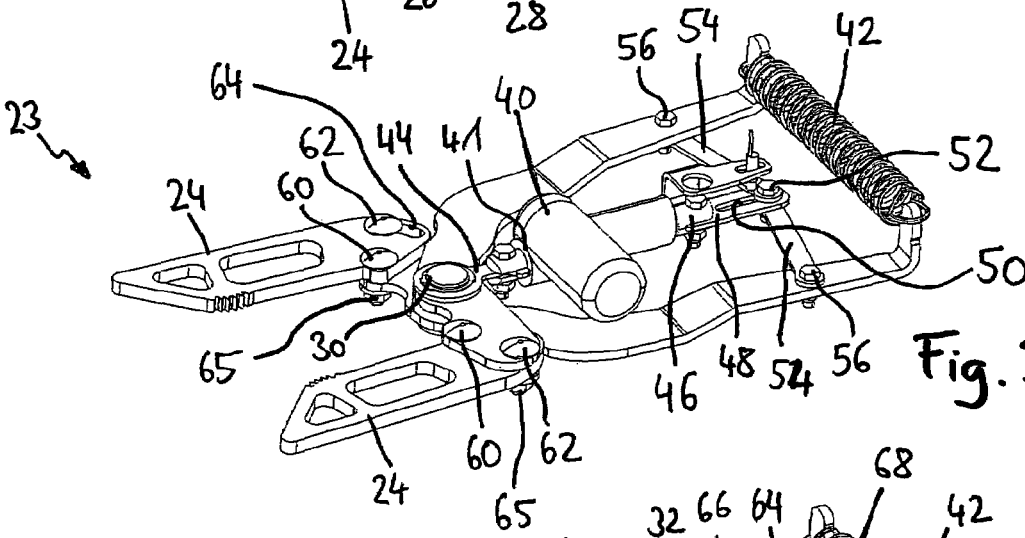
Figure 4:
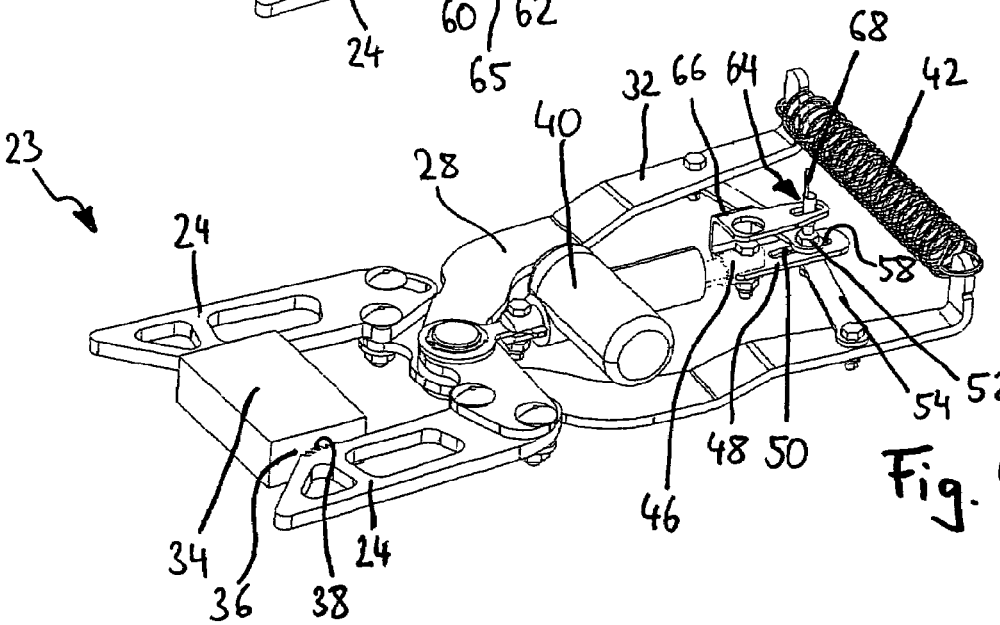

The invention will be explained in more detail below using a preferred exemplary embodiment with reference to the attached drawings, in which:

FIG. 1 shows a perspective overall view of a stacker according to the invention, FIG. 2 shows a perspective view of a clamping device in accordance with an exemplary embodiment of the present invention, in an empty position, FIG. 3 shows a perspective view of the clamping device shown in FIG. 2, in a release position, and FIG. 4 shows a perspective view of the clamping device shown in FIG. 2, in a clamping position.

In FIG. 1, an industrial truck in the form of a stacker is overall given the reference 10. The stacker 10 comprises a lifting mast 12 having a vertical guide, on which a load-receiving means 14 in the form of two fork prongs 16 can be moved vertically by means of a lifting force applied by a drive assembly 18. In FIG. 1, the load-receiving means 14 is located in the completely lowered position.

In the region of the load-receiving means 14, the stacker 10 also has a driver's platform 19 having a standing area 20 on which an operator of the stacker can stand in order to load or unload the load-receiving means or to move it vertically. In addition, the drive assembly 18 also has means for driving drive wheels (not illustrated) by means of which the entire stacker 10 can be moved to different use points, the operator in this case travelling with it, standing on the standing board 20. Rollers 22 are formed for the purpose of supporting large loads.

The stacker shown in FIG. 1 is designed in particular for use with pallets (not shown) which have a uniform, rectangular base area, in a manner known per se, and have a loading area and, fixed thereto, a number of block-like or bar-like foot parts in order to hold the loading area of the pallet at a distance above the ground. The foot parts are dimensioned and arranged such that they leave apertures for the fork prongs 16 of the stacker 10 below the loading area on either side of the centre of the loading area. Pallets are generally standardized at least in regions, for example those known as "Euro pallets". For the purpose of receiving a pallet, the stacker 10 is then moved with its fork prongs 16 through the apertures in the pallet such that, when the fork prongs 16 are lifted, the pallet rests with the underside of its loading area on the prongs 16.

In this state, a clamping device 23 is then actuated in order to fix the pallet in the clamping engagement securely on the load-receiving means 14 of the stacker 10 and in order to prevent the pallet from sliding or tipping off from the fork prongs 16. In this case, the clamping device grips both sides of a foot part of the pallet which is located laterally and centrally below the loading area of the pallet and is fixedly connected to the loading area or is designed to be integral therewith.

Of the components in the clamping device 23, only two clamping jaws 24, 24 can be seen in FIG. 1 for coming into engagement with the pallet. Other components in the clamping device 23 are arranged below the standing area 20. Reference will be made below to FIGS. 2 to 4 for a more detailed description of the clamping device 23 in accordance with an exemplary embodiment of the present invention.

The clamping jaws 24, 24 already mentioned are each fixed to a shorter arm 26, 26 of a twin-arm lever 28, 28. The clamping jaws 24, 24 and twin-arm levers 28, 28 in each case together form two identical, symmetrical clamping means and are of simple design. The two twin-arm levers 28, 28 are mounted together on a common pivot bolt 30 such that they can rotate and such that, overall, a tweezer design results, in the case of which a movement of longer arms 32, 32 of the twin-arm levers 28, 28 is converted into a movement towards and away from one another between the clamping jaws 24, 24.

It is thus possible for a foot part 34 of the pallet to be taken into clamping engagement in the form of tweezers in a clamping position (shown in FIG. 4) at clamping regions 36 of the foot part 34 which are arranged on either side of said foot part 34 or to be released in a release position (shown in FIG. 3) by the clamping jaws 24, 24 being opened. In the clamping position, the clamping jaws 24, 24 hold the foot part 34 by means of the frictional engagement in each case between toothed clamping sections 38 of the clamping jaws 24 and the clamping regions 36 of the foot part 34.

In order to move the twin-arm levers 28, 28 and thus the clamping jaws 24, 24 between the clamping position and the release position, the clamping device comprises a drive arrangement 40 and a helical spring as the tension spring 42. The two ends of the tension spring 42 are in each case hooked in at the ends of the long arms 32, 32 of the twin-arm levers 28, 28 such that the tensile force, which acts in the contraction direction of the tension spring 42, of the spring 42 presses the ends of the long arms 32, 32 towards one another. The clamping device is thus prestressed such that the twin-arm levers 28, 28 and thus the clamping jaws 24, 24 are subjected to force in the clamping position, and the foot part 34 is held in the clamping position by means of the force of the spring 42.

While the tension spring 42 prestresses the clamping device in a closed position, a force can be applied to the twin-arm levers 28, 28 by means of the drive arrangement 40 for the purpose of spreading apart the long arms 32, 32 against the tensile force of the spring 42 in order to move the clamping device 23 from the empty position (FIG. 2) or from the clamping position (FIG. 4) to the release position (FIG. 3). For this purpose, a base part 41 of the drive device 40 is connected to the pivot bolt 30 of the twin-arm levers 28, 28 via a rigid connecting element 44, while a movement part 46, for example the withdrawable spindle of a spindle drive, is coupled to the twin-arm levers 28, 28 via a slot coupling, which is described in more detail below, and a toggle joint arrangement.

In detail, the slot coupling comprises a coupling part 48, which is fixed to the movement part 46, having a slot 50 which is formed therein in the longitudinal direction of the clamping device. The slot 50 has an axle bolt 52 passing through it which can be rotated within the slot 50 and displaced along the slot 50. This axle bolt 52 forms the toggle joint of a toggle joint arrangement, for which purpose two limbs 54 of the toggle joint arrangement are borne, by one of their ends, on the axle bolt 52 such that they can pivot. The limbs 54 are borne such that they can rotate, by their other end, on pivots 56 on the long arms 32, 32 of the twin-arm levers 28, 28.

Owing to a movement of the toggle joint (at 52) in the longitudinal direction of the clamping device 23, a relatively large force can be transmitted by the toggle joint arrangement formed in this manner for the purpose of spreading apart the long arms 32, 32 and thus for the purpose of spreading apart the clamping jaws 24, 24. At the same time, the clamping device 23 is stabilized by the toggle joint arrangement since forces and impacts, which act on the twin-arm levers 28, 28 during holding of the load or during insertion and removal of the load between the clamping jaws 24, 24 and which occur in particular in the case of the clamping jaws 24, 24 being pushed away from one another asymmetrically, can be absorbed by the limbs 54, 54 of the relatively obtuse-angled toggle joint.

The operation of the clamping device 23 when holding or releasing the foot part 34 of the pallet will be explained below. In all positions of the clamping device 23, the tension spring 42 pushes the long arms 32, 32 and thus also the clamping jaws 24, 24 towards one another and moves them in this direction until this movement is blocked, to be precise in the clamping position by the foot part 34 and in the other positions by the drive arrangement by means of the toggle joint arrangement and the slot coupling. If the pallet 34 has not yet been pushed onto the fork prongs 16 of the stacker 10, the clamping device 23 may be located, for example, in the empty position shown in FIG. 2. In this empty position, the tension spring 42 buckles the toggle joint arrangement until the axle bolt 52 comes to bear against an outer longitudinal end 58 of the slot 50. The minimum opening of the jaws 24, 24 is then determined by the instantaneous excursion path of the movement part 46 of the drive arrangement 40 such that the opening movement in the clamping device 23 by means of the drive arrangement 40 being driven can be carried out by inserting and withdrawing the movement part 46. In the event of an unloaded movement of the twin-arm levers 28 of the clamping device 23, i.e. in particular if no load is clamped between the clamping jaws 24, 24, the tension spring 42 always holds the axle bolt 52 at the outer longitudinal end 58 of the slot 50 and thus makes it possible for a force to be transmitted between the drive arrangement 40 and the twin-arm levers 28, 28.

In order to accommodate the foot part 34 between the clamping jaws 24, 24, the clamping jaws 24, 24 are opened sufficiently wide by the drive arrangement 40 and are moved towards one another, i.e. in the closing direction, once the foot part 34 has been inserted between the clamping jaws 24, 24 until the clamping sections 38, 38 of the clamping jaws 24, 24 come to bear against the clamping regions 36 of the foot part 34. At this point in time, the tensile force of the spring 42 is no longer absorbed only by the axle bolt 52 bearing against the outer end 58 of the slot 50 but is now also absorbed by the clamping part 34. If the drive arrangement 40 is driven further in the removal direction of the movement part 46 beyond this point, the toggle joint with the axle bolt 52 can no longer follow this removal movement, and the outer longitudinal end 58 of the slot 50 protrudes from the axle bolt 52 (as shown in FIG. 4) such that the axle bolt 52 moves into an intermediate location between the longitudinal ends of the slot 50. There is then essentially no longer any force transmission between the axle bolt 52 and the coupling part 48 such that the clamping force to be applied for the purpose of holding the foot part 34 is essentially only applied by the tension spring 42. The drive arrangement 40 may now be switched over to an energy-saving standby state or even switched off and in any case need no longer apply a permanent force. Direct force reaction from the clamping jaws 24, 24 to the drive arrangement 40 is also not possible in this position.

In order to release the clamping engagement with the foot part 34 and to release the foot part 34 again, the drive arrangement 40 is again driven in the insertion direction until the outer longitudinal end 58 of the slot 50 again comes to bear with the axle bolt 52. When the drive arrangement 40 is further inserted, the above-described force transmission of the drive arrangement 40 onto the twin-arm levers 28 again takes place, and the clamping device 23 opens.

A further important aspect of the clamping device 23 according to the invention lies in the possibility of setting the distance between the clamping jaws 24 for a specific removal position of the drive arrangement. It is thus made possible for the clamping device 23 to be set individually for different loads, in particular for pallets having foot parts 34 having different dimensions.

For this purpose, the clamping jaws 24, 24 are fixed to the short arms 26, 26, in the exemplary embodiment of the invention shown in the figures, in each case by means of a first screw 60 and a second screw 62. The first screw 60 is in this case guided by in each case two aligned holes in the short arm 26 and the clamping jaw 24, while the second screw 62 is guided by a hole in the short arm 26 and by a circular arc-shaped slot 64 in the clamping jaw 24. In order to make it possible to unscrew and tighten the screws 60, 62 easily for the purpose of adjusting the clamping jaws 24, 24 using a single tool, the screw shafts of the screws 60, 62 have square attachments which bear against at least two opposing, planar bearing faces of the cutouts in the twin-arm levers 28, 28 or the clamping jaws 24, 24, which cutouts are in each case passed through. In order to unscrew or tighten the screws 60, 62, only nuts 65, 65 need then be tightened or unscrewed on the screws 60, 62. Counter-holding of the screw heads is dispensed with in this case such that the nuts 65, 65 can easily be actuated from outside.

Once the screws 60, 62 have been unscrewed, the jaw 24 can then be pivoted about the screw 60, while the screw 62 is guided in the slot 64. Once a desired distance between the clamping jaws 24, 24 has been set, the two screws 60, 62 can then be screwed tight in order to fix the set position. Alternatively, the engagement between the second screw 62 and the clamping jaw 24 may also be provided as an interlocking engagement in place of the clamping engagement with the slot 64; in particular, the slot 64 may be replaced by a plurality of discrete adjustment holes in the clamping jaw 24.

In addition to the option of operating the drive arrangement 40 in the clamping state (FIG. 4) of the clamping device 23 without power, the present invention also offers the possibility of reliably detecting setting of such a clamping position. The clamping position is shown, namely by the axle bolt 52 being lifted off from the outer longitudinal end 58 of the slot 50. In the preferred exemplary embodiment of the invention shown in the figures, the clamping device 43 has a clamping position sensor 64 for this purpose. The clamping position sensor 64 comprises a retaining clip 66 which is fixedly connected to the coupling part 48 so as to move jointly with said coupling part 48. The retaining clip 66 extends at a predetermined distance above the slot 50 and bears at its front end a sensor head 68, for example of a proximity sensor. In this case, the retaining clip 66 holds the sensor head 68 always in such a position above the slot that the sensor head 68 can detect a state in which the axle bolt 52 is located in an intermediate location between the longitudinal ends of the slot 50.

The signal from the sensor head 68 may in this case be fed to a control/regulating unit of the stacker 10 or indicated in some other way, for example to an operator. However, it is conceivable in principle for the signal from the sensor head 68 to be coupled to the controller/regulator of the drive arrangement 40 such that, when the clamping device 23 is changed over from the release position to the clamping position, the movement of the drive arrangement 40 is stopped precisely when the axle bolt 52 is located below the sensor head 68, i.e. in an intermediate location between the longitudinal ends of the slot 50, i.e. when it is ensured that the foot part 34 is fixed securely by the clamping device 23. Furthermore, this clamping state can then be indicated to the operator of the stacker in order to indicate that the pallet is now fixed securely and can be walked on, if necessary. Actuation of the clamping device 23 may be controlled completely automatically in this manner such that the operational complexity and in particular the force required for actuating the clamping device are minimized or eliminated entirely.

One further point is the fact that the elements forming the clamping means (clamping jaw 24 and twin-arm lever 28) are very similar to the two clamping means shown. The two clamping jaws 24, 24 are essentially identical; the twin-arm levers 28, 28 may likewise be identical but are shaped in mirror-image form as regards their bent-back sections in FIGS. 2 to 4.

The pivot bolt 30 divides each clamping means into a first lever arm, comprising the clamping jaw 24 and the short arm 26 of the twin-arm lever 28, and a second lever arm in the form of the long arm 32 of the twin-arm lever 28.

The invention claimed is:

1. Industrial truck having a load-receiving device for the purpose of receiving a load and lifting and dropping the load, said load-receiving device having a clamping device to hold a clamping region of the received load in clamping engagement, the clamping device being vertically moveable, and having at least one clamping means which is adapted to move between a clamping position and a release position, a drive arrangement, which is coupled to at least one of the clamping means by a coupling, for the purpose of moving the at least one clamping means and an elastic device which prestresses the at least one clamping means in a movement direction, wherein the elastic device prestresses the at least one clamping means in a direction of a clamping position for the purpose of exerting a clamping force on the clamping region of the load by means of the clamping means, the clamping means being in the form of lever elements which can be pivoted about a common pivot bolt towards and away from one another, and wherein the elastic device is connected with the lever elements respectively.

2. Industrial truck according to claim 1, wherein the clamping device is configured to exert the clamping force in the clamping position on the clamping region of the load for the purpose of holding the load, wherein the clamping force is applied essentially exclusively by the elastic device.

3. Industrial truck according to claim 1, wherein the clamping device is adjustable such that it is possible to set a distance between a plurality of clamping sections given a predetermined position of the drive arrangement, the clamping sections being portions of the clamping means configured to bear against the clamping region of the load.

4. Industrial truck according to claim 3, wherein at least one of the clamping means is of multi-part design, and a clamping jaw part, which bears at least one of the clamping sections, can be mounted on a support part of the clamping means in different mounting positions or at different mounting locations.

5. Industrial truck according to claim 4, wherein the clamping jaw part is attached to the support part such that it can be moved, on one of the clamping sections which is operatively connected to a second clamping means towards and away from said second clamping means, it being possible for the clamping jaw part and the support part to be fixed in relation to one another by means of a locking device.

6. Industrial truck according to claim 1, wherein the coupling between the at least one clamping means and the drive arrangement comprises a slot coupling, in which a pin, which is connected to a first part of the clamping means or the drive arrangement, is received in a slot in a coupling part, which is connected to a second part of the drive arrangement or clamping means such that it can be displaced in relation to said coupling part, the coupling being designed such that a force is transmitted between the pin and the coupling part essentially only by the pin bearing against a longitudinal end region of the slot.

7. Industrial truck according to claim 6, wherein the pin, in the clamping position of the clamping device, is located at an intermediate location between two longitudinal end regions of the slot.

8. Industrial truck according to claim 1, wherein the clamping device comprises a clamping position sensor which indicates that the clamping device is located in the clamping position.

9. Industrial truck according to claim 7 wherein a clamping position sensor detects the location of the pin within the slot and the clamping position sensor recognizes from this that the pin is located at an intermediate location between the two longitudinal end regions of the slot.

10. Industrial truck according to claim 9, wherein the clamping position sensor is connected so as to move with the coupling part.

11. Industrial truck according to claim 8, further including a control/regulating device for controlling/regulating the movement of the drive arrangement, the control/regulating device stopping movement of the drive arrangement from the release position to the clamping position of the clamping device when the clamping position sensor indicates that the clamping device is in the clamping position.

12. Industrial truck according to claim 1, wherein the drive arrangement is connected to the clamping means for transmitting motive force via a toggle joint arrangement, the toggle joint arrangement having limbs that are each connected to one of the clamping means such that they can rotate, and having a toggle joint that is coupled to the drive arrangement.

13. Industrial truck according to claim 6, wherein the coupling part with the slot is located on a driven element of the drive arrangement and a toggle joint can be displaced along the slot.

14. Industrial truck according to claim 1, wherein the drive arrangement is an electrical drive arrangement.

15. Industrial truck according to claim 1, wherein the drive arrangement can be actuated by a control or operating unit of the industrial truck automatically or at the request of an operator.

16. Industrial truck according to claim 9, further including a control/regulating device for controlling/regulating the movement of the drive arrangement, the control/regulating device stopping movement of the drive arrangement from the release position to the clamping position of the clamping device when the clamping position sensor indicates that the clamping device is in the clamping position.

17. Industrial truck according to claim 10, further including a control/regulating device for controlling/regulating the movement of the drive arrangement, the control/regulating device stopping the movement of the drive arrangement from the release position to the clamping position of the clamping device when the clamping position sensor indicates the that the clamping device is in clamping position.

18. Industrial truck according to claim 8, wherein the drive arrangement includes a driven element having a coupling part with a slot, and a toggle joint displaced along the slot.

19. Industrial truck according to claim 12, wherein the drive arrangement includes a driven element having a coupling part with a slot, the toggle joint being displaced along the slot.

* * * * *